United States Patent [19]

Giori

[11] Patent Number: 5,062,359

[45] Date of Patent: Nov. 5, 1991

[54] INTAGLIO PRINTING MACHINE FOR THE PRINTING OF CURRENCY PAPERS

[75] Inventor: Gualtiero Giori, Lonay, Switzerland

[73] Assignee: De La Rue Giorgi S.A., Lausanne, Switzerland

[21] Appl. No.: 518,146

[22] Filed: May 3, 1990

[30] Foreign Application Priority Data

Jun. 29, 1989 [CH] Switzerland ..... 2422/89

[51] Int. Cl.[5] ..... B41F 9/02

[52] U.S. Cl. ..... 101/152; 101/153; 101/175

[58] Field of Search ..... 101/150, 151, 152, 153, 101/175, 170

[56] References Cited

U.S. PATENT DOCUMENTS

| | | | |
|---|---|---|---|
| 4,516,496 | 5/1985 | Giori | 101/152 |
| 4,552,066 | 11/1985 | Giori et al. | 101/152 |
| 4,794,856 | 1/1989 | Giori | 101/152 |
| 4,942,813 | 7/1990 | Arai | 101/152 |
| 4,981,078 | 1/1991 | Dettinger et al. | 101/425 |

*Primary Examiner*—Edgar S. Burr

*Assistant Examiner*—Ren Yan

*Attorney, Agent, or Firm*—Kane, Dalsimer, Sullivan, Kurucz, Levy, Eisele and Richard

[57] ABSTRACT

The intaglio printing machine comprises a plate cylinder (4) with a plurality of engraved printing plates equipped with intaglio cuts representing the elements of a main design and with less deep and finer intaglio cuts representing the elements of a safety background, an impression cylinder (3), a wiping device (10) and a multicolor inking system. This inking system consists of a collector inking cylinder (5) having an elastic surface interacting with the engraved plates mounted on the plate cylinder (4) and having the same diameter as this. The collector inking cylinder (5) is inked by as many selective color inking cylinders (7) as there are colors to be printed, these selective color inking cylinders (7) having reliefs corresponding to the colored zones of the safety background and of the main design, an inking device (8) being associated with each selective color inking cylinder (7). If appropriate, the diameter of the collector inking cylinder can also be double or triple the diameter of the plate cylinder.

9 Claims, 1 Drawing Sheet

INTAGLIO PRINTING MACHINE FOR THE PRINTING OF CURRENCY PAPERS

FIELD OF THE INVENTION

The invention relates to a sheetfed or webfed intaglio printing machine for currency papers, especially bank notes, comprising a plate cylinder with several printing plates, an impression cylinder, a wiping device and an inking system consisting of a collector inking cylinder having an elastic surface interacting with the printing plates, of selective color inking cylinders having reliefs corresponding to the colored zones to be printed in different colors and in contact with the periphery of the collector inking cylinder, and of an inking device associated with each selective color inking cylinder.

To increase the safety factor against the falsification of currency papers of any kind, it has been found expedient to produce currency papers entirely by means of the intaglio printing process, because it is much more difficult to falsify a currency paper produced completely by intaglio printing, this also applying to the safety backgrounds.

PRIOR ART

For this reason, the applicant has already provided, in the document EP-B 091,709, an intaglio printing machine such as that described in the predefining clause of claim 1. In this known machine there is a collector inking cylinder of a diameter smaller than that of the plate cylinder, and this collector inking cylinder, together with the selective color inking cylinders associated with it, inks on the printing plate only less deep intaglio cuts representing the safety background. For the inking of the deep intaglio cuts representing the main design, this machine is equipped with a conventional inking roller equipped with an inking device for the direct inking of the plate. In fact, it was thought that, in order to fill the deep intaglio cuts of a main design correctly, it was essential to use direct inking with a relatively high pressure of the inking roller against the plate.

This known machine therefore has a relatively complicated configuration because of the presence of an indirect inking device and of at least one direct inking device. Moreover, this machine requires a very exact and careful adjustment of the collector inking cylinder in relation to the plate cylinder, on the one hand, and of the inking roller in relation to the plate cylinder and the collector inking cylinder, on the other hand, in order to obtain a correct register between the various parts of the image to be printed.

SUMMARY OF THE INVENTION

The object of the present invention is to provide a new machine of simplified construction, capable of printing a currency paper, having a finely engraved multicolor safety background and a deeply engraved main design, entirely by intaglio printing and in a single pass, in this machine the adjustment of the register between the elements inking the safety background and the main design being greatly simplified.

To achieve this, the machine according to the invention is characterized in that the diameter of the collector inking cylinder is equal to N times the diameter of the plate cylinder, N being an integer between 1 and 3.

The measures according to the invention result in two beneficial effects: on the one hand, the same inked zones on the collector inking cylinder always come exactly in contact with the same zones of the same engraved plate; on the other hand, the diameter of the plate cylinder and of the collector inking cylinder are relatively large, since the plate cylinder generally has to carry at least two engraved printing plates, preferably three or four engraved plates. For a plate cylinder carrying three plates, the diameter is, for example, 840 mm. As a result of the large diameter of these two cylinders, the band of contact for good inking can be obtained with a lower compression force than with a collector inking cylinder of smaller diameter, and moreover the separation of the contact zones immediately after the transfer of the ink is not as abrupt as with a smaller collector inking cylinder.

It has been proved that several surprising advantages arise from these two effects:

The collector inking cylinder makes it possible to fill correctly and completely not only fine intaglio cuts representing the safety background, but also deeper intaglio cuts representing the main design and even, as it has been possible to ascertain, deep intaglio cuts extending to 250 to 300 $\mu$, this representing a depth almost twice as great as that generally used hitherto during the direct inking of the main designs. It seems that this surprising advantage is attributable to the fact that, during the operation, there forms on the periphery of the collector inking cylinder a kind of ink relief which is sufficient to fill the deepest intaglio cuts and which is always renewed as a result of the inking by the selective color inking cylinders. It had always been thought hitherto that, to obtain a correct filling of the deep intaglio cuts, it was absolutely essential to have an inking roller touching the plate directly with considerable pressure. It has been possible for the invention to overcome this prejudice.

Moreover, with this indirect inking according to the invention, the fact that the selective color inking cylinders can be cut from more or less hard material very finely and very accurately and the fact that the plates are inked by the collector inking cylinder made of more or less flexible material mean that the quantity of ink is the minimum necessary for obtaining the best possible inking, thus representing an appreciable saving of ink in relation to direct inking, hence less ink to be wiped on the surface of the plates, and thus consequently relieving the wiping device, this being very important.

Another very important advantage is that, once the adjustment of all the selective color inking cylinders in relation to the collector inking cylinder and to the plates has been carried out, there is an automatic register between the inking of the main design and that of the safety background, and any other adjustment necessary hitherto is omitted.

Because of the size of the collector inking cylinder, there is more room along its periphery to install a larger number of selective color inking cylinders, preferably four and even five. Consequently, it is perfectly possible to use at least one selective color inking cylinder for inking the main design and the other three or four for inking the safety background in a multicolor manner.

The direct inking device is, of course, omitted, thereby making the construction and maintenance of the machine much easier.

BRIEF DESCRIPTION OF THE DRAWING

The invention will be described by way of nonlimiting example with reference to the accompanying drawing, the single FIGURE of which shows diagrammatically a sheetfed intaglio printing machine produced according to the present invention.

DESCRIPTION OF THE PREFERRED EMBODIMENT

Figure 1:
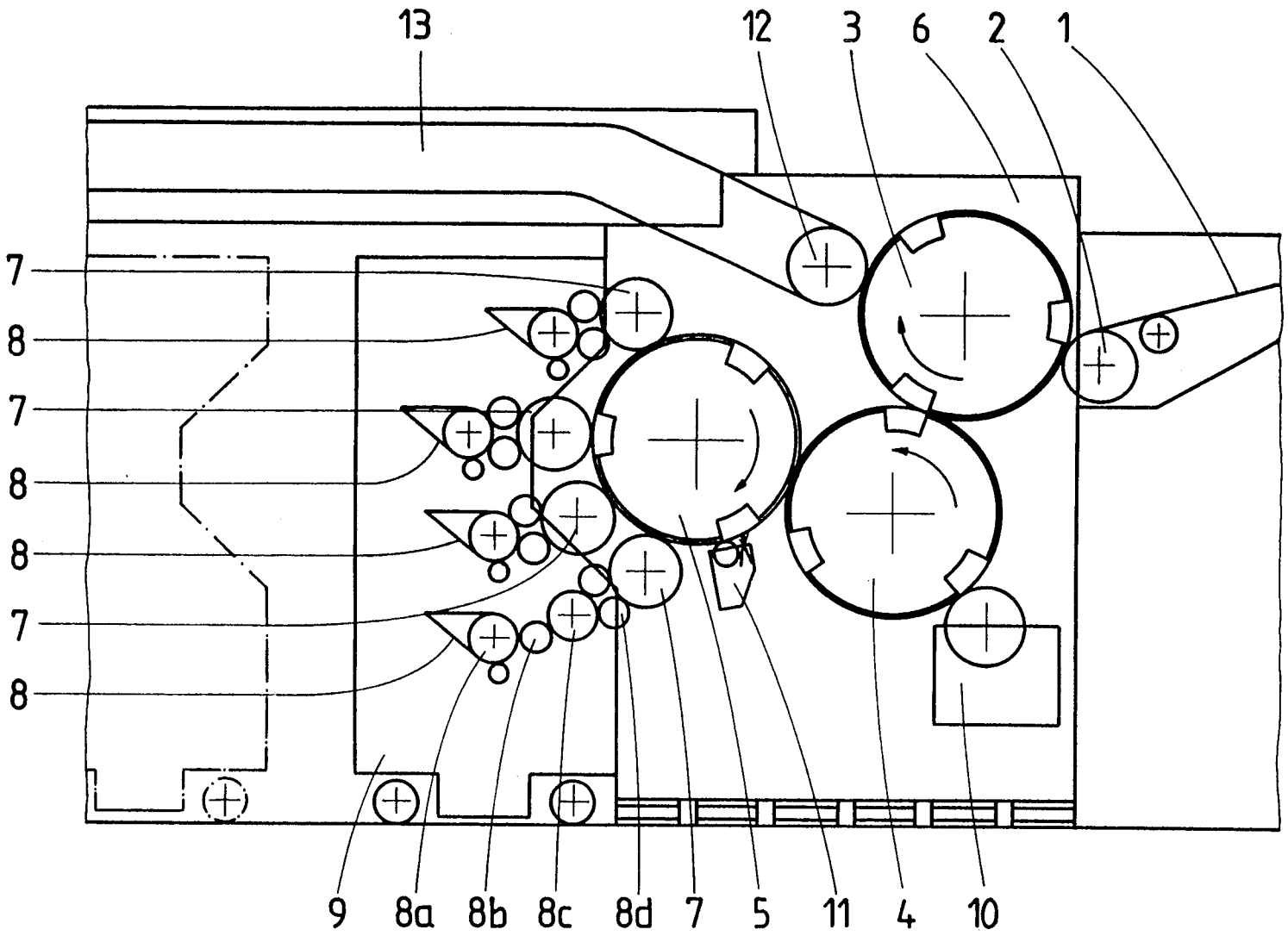

The machine illustrated comprises an impression cylinder 3, a plate cylinder 4 interacting with the latter and having the same diameter as this and a collector inking cylinder 5 in contact with the plate cylinder 4. The plate cylinder 4 is equipped with several engraved printing plates distributed uniformly. In this particular instance, it carries three plates and has a diameter of 840 mm. The collector inking cylinder 5 having an elastic surface has the same diameter as the plate cylinder 4 and, in the example in question, like the impression cylinder 3 is equipped with three blankets. Along the periphery of the collector inking cylinder 5 and in contact with this are mounted selective color inking cylinders 7, each being inked by means of its own inking device 8.

The direction of rotation of the various cylinders is represented by arrows in the drawing. The three cylinders 3, 4 and 5 mentioned and the selective color inking cylinders 7 are installed in a main frame 6. The collector inking cylinder 5 and the selective inking cylinders 7 can also be installed in a movable carriage which can be separate from the main frame 6.

Engraved on the engraved printing plates are both the main design to be printed, formed by intaglio cuts of variable dimensions and relatively deep, with a depth extending to 250 to 300 microns, and the safety background formed by very fine intaglio cuts consisting, above all, of very fine lines or even dots, these cuts being less deep than those forming the main design.

Located on the periphery of the plate cylinder 4, after the collector inking cylinder 5 in the direction of rotation, is a wiping device 10 which cleans the surface of the engraved plates outside their intaglio cuts and which compresses the ink into the cuts.

Furthermore, on the periphery of the collector inking cylinder 5 there is an automatic blanket-washing device 11 which is put out of contact with this cylinder during the printing operation.

As mentioned, the collector inking cylinder 5 possesses three rubber blankets, as used for offset blanket cylinders. All the various colors for the complete inking of the engraved plates are transferred onto this collector inking cylinder 5. It therefore interacts with as many selective color inking cylinders 7 as there are different colors. In the embodiment illustrated, the collector inking cylinder 5 interacts with four selective color inking cylinders 7, the surface of which is made of hard material, for example plastic, metal or hardened rubber, each selective inking cylinder being divided into sections so as to have relief zones, the contours of which correspond exactly to those of the surfaces to be printed in the respective color. These relief zones are obtained by any known means, for example by laser cutting. Since the surface of the selective color inking cylinders is hard, there is no limit to the fineness of the design to be obtained. It is even possible to produce a safety background having not only very fine lines, but also dots, this being unattainable hitherto.

Each selective color inking cylinder 7 is associated with an inking device 8 comprising the actual ink fountain and the color transfer rollers. Moreover, to make it more convenient for the user, the lower inking device possesses two intermediate transfer rollers **8*b* and 8*c* between the ink-fountain cylinder 8*a* and the rollers 8*d*. All the inking devices 8 together with the rollers are installed in a movable inking carriage 9 which can be separated from the main frame 6, this retracted position being represented by dot-and-dash lines in the FIGURE. When, as mentioned, the collector inking cylinder 5 and the selective color inking cylinders are installed in a separate movable carriage, the movable inking carriage 9** can of course be separated from this.

In the embodiment illustrated in the FIGURE, the ratio of the diameters of the selective color inking cylinders 7 and of the collector inking cylinder 5 is 1:3.

The paper in sheet form is fed to the machine by means of a sheet feed device 1 and a transfer cylinder 2 which gives the sheets to the impression cylinder 3. The paper, held on this cylinder by means of grippers, passes between this cylinder and the plate cylinder 4, where it receives the print, and it is subsequently transported to a transport device 13 by means of another transfer cylinder 12.

It has been shown that the pressure between the collector inking cylinder 5 and the plate cylinder 4 can be lower than in direct inking by means of an inking roller, and that, despite this low pressure, the complete filling of the intaglio cuts is guaranteed.

Likewise, only slight pressure, reduced virtually to mere contact, is needed between the selective color inking cylinders 7 and the collector inking cylinder 5, thereby avoiding a deformation of the very fine zones cut out on the selective inking cylinders.

To ensure a perfect register between the selective inking cylinders 7 divided into sections and the engraved printing plates, the following procedure is adopted: one of the selective inking cylinders 7 not yet divided into sections is mounted on the machine; the printing plate is subsequently mounted on the plate cylinder 4 and is inked and wiped; its image is then transferred to the selective inking cylinder 7 by means of the collector inking cylinder 5, in such a way that the image of the plate remains printed on this cylinder not yet divided into sections. The selective inking cylinder 7 is thereafter removed from the machine, and the image of the plate is used for cutting the surface by any suitable means. When their cutting is obtained by means of a laser, the image of the plate serves as a base for coordinates to be entered in the laser machine, so that cutting keeps perfectly to the design in register with the plate. The same operation is, of course, repeated for the other selective inking cylinders 7 representing the other colors. Under these conditions, an automatic register of the inking of the safety background and of the main design is obtained.

As can be seen in the drawing, the arrangement of the machine is preferably such that the line connecting the axes of the impression cylinder 3 and of the plate cylinder 4 is perpendicular to the line connecting the axes of the plate cylinder 4 and of the collector inking cylinder 5, and that the impression cylinder 3 is located at least approximately vertically above the plate cylinder 4. Under these conditions, even if the plate cylinder were to experience bending of a few fractions of a millimeter attributable to the high pressure necessary for intaglio printing, this would in no way interfere with the collector inking cylinder 5.

It is also possible for the collector inking cylinder 5, instead of having individual blankets, to be equipped with a continuous and smooth flexible surface, above all where a webfed printing machine is concerned.

It is also possible for the diameter of the collector inking cylinder 5 to have a diameter equal to twice, even three times the diameter of the plate cylinder 4, if a reduced dimension of the latter allows such a size of the collector inking cylinder 5 for practical reasons. This would provide even more room for installing a larger number of selective color inking cylinders together with their inking device. In this case, the number of blankets on the collector inking cylinder 5 is respectively twice and three times the number of plates on the plate cylinder 4.

The invention is not limited to the embodiment just described, but also embraces different embodiments, particularly as regards the number of printing plates and the number of printed colors.

I claim:

1. A sheetfed or webfed intaglio printing machine for currency papers, especially bank notes, comprising: a plate cylinder (4) with several printing plates, and impression cylinder (3), a wiping device (10) and an inking system consisting of a collector inking cylinder (5) having an elastic surface interacting with the printing plates, selective color inking cylinders (7) having reliefs corresponding to the colored zones to be printed in different colors and in contact with the periphery of the collector inking cylinder (5), and a separate inking device (8) associated with each selective color inking cylinder (7), wherein the diameter of the collector inking cylinder (5) is equal to N times the diameter of the plate cylinder (4), N being an integer ranging from 1 to 3; wherein the printing plates are equipped with intaglio cuts representing the elements of a main design and with less deep and finer intaglio cuts representing the elements of a safety background, and wherein at least one selective color inking cylinder transfers by direct contact the ink to the collector inking cylinder (5) in order to ink the intaglio cuts representing the main design, while the other selective color inking cylinders transfer by direct contact the ink to the collector inking cylinder (5) in order to ink the intaglio cuts representing the multicolor safety background.

2. The intaglio printing machine as claimed in claim 1, wherein the collector inking cylinder (5) is a blanket cylinder, and wherein the ratio of the number of blankets to the number of printing plates is equal to the ratio of said diameters.

3. The intaglio printing machine as claimed in claim 1, wherein the diameter of the collector inking cylinder is equal to the diameter of the plate cylinder.

4. The intaglio printing machine as claimed in claim 1, wherein the plate cylinder (4) carries at least two, preferably three or four printing plates.

5. The intaglio printing machine as claimed in claim 1, wherein there are at least three, preferably four selective color inking cylinders (7).

6. The intaglio printing machine as claimed in claim 1, wherein the line connecting the axes of the impression cylinder (3) and of the plate cylinder (4) is perpendicular to the line connecting the axes of the plate cylinder (4) and the collector inking cylinder (5), and in that the impression cylinder (3) is located at least approximately vertically above the plate cylinder (4).

7. The intaglio printing machine as claimed in claim 1, wherein the plate cylinder and the impression cylinder are installed in a main frame (6), in that the collector inking cylinder (5) and the selective color inking cylinders (7) are installed in a first carriage, and in that the inking devices (8) are installed in a second carriage.

8. The intaglio printing machine as claimed in claim 1, wherein on the periphery of the collector inking cylinder (5) is a device (11) for the automatic washing of the blankets or respectively of the flexible and continuous surface of this collector inking cylinder, the said washing device being put out of contact with this cylinder during the printing operation.

9. The intaglio printing machine as claimed in claim 1, wherein at least some of the intaglio cuts of the main design have a depth in the range of up to 250 to 300 $\mu$m.

* * * * *